United States Patent [19]

Nielsen

[11] 4,158,437

[45] Jun. 19, 1979

[54] THERMOSTATIC EXPANSION VALVE FOR REFRIGERATION PLANTS

[75] Inventor: Leif Nielsen, Nordborg, Denmark

[73] Assignee: Danfoss A/S, Nordborg, Denmark

[21] Appl. No.: 757,990

[22] Filed: Jan. 10, 1977

Related U.S. Application Data

[63] Continuation of Ser. No. 644,756, Dec. 29, 1975, abandoned.

[30] Foreign Application Priority Data

Dec. 16, 1974 [DE] Fed. Rep. of Germany ..... 2459485

[51] Int. Cl.[2] ..... F16K 31/126

[52] U.S. Cl. ..... 236/92 B; 137/505.18

[58] Field of Search ..... 236/92 B; 137/505.18

[56] References Cited

U.S. PATENT DOCUMENTS

| | | | |
|---|---|---|---|
| 2,786,336 | 3/1957 | Lange | 236/92 B UX |
| 3,322,142 | 5/1967 | Baumann | 251/61 X |
| 3,392,749 | 7/1968 | Grierding | 137/505.18 |
| 3,402,566 | 9/1968 | Leimbach | 137/505.18 X |
| 3,769,811 | 11/1973 | Jespersen | 236/92 B X |
| 3,902,522 | 9/1975 | Karenfeld | 137/505.18 X |

*Primary Examiner*—Alan Cohan

*Attorney, Agent, or Firm*—Wayne B. Easton

[57] ABSTRACT

The disclosure relates to a thermostatic expansion valve for refrigeration plants, particularly with an air-cooled condenser, comprising an operating element which is loaded in the opening direction against the force of a spring by a pressure dependent on the superbeating temperature of the evaporator and possibly relieved by the evaporator pressure, and comprising a closure member which is adjustable by the operating element and co-operates with a seat.

1 Claim, 2 Drawing Figures

Fig. 1
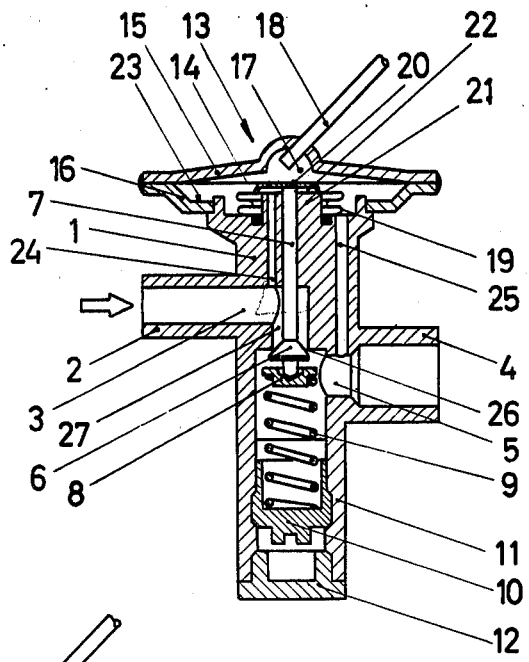
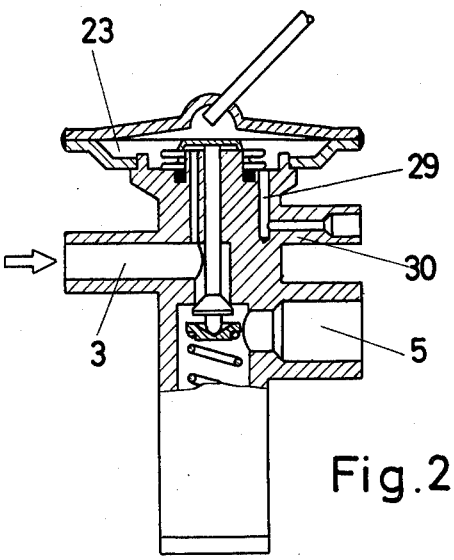
Fig. 2

THERMOSTATIC EXPANSION VALVE FOR REFRIGERATION PLANTS

This application is a continuation of application Ser. No. 644,756 filed on Dec. 29, 1975, now abandoned.

Thermostatic expansion valves are disposed between the condenser and evaporator of a refrigeration plant. They have the object of supplying the evaporator with so much refrigerant that the superheating temperature at the end of the evaporator remains substantially constant. They must also be capable of providing a complete seal between the evaporator and the condenser.

Whereas one can assume that the evaporator pressure is constant or subjected to only slight fluctuations, the condenser pressure can undergo considerable changes in response to the condenser temperature. For air-cooled condensers, condenser pressures can arise in the summer that are 5 to 10 times larger than those in winter. Since an elevated pressure difference gives rise to a higher throughput quantity at a given opening of the valve, control relationships in the summer are completely different from those in the winter. If the expansion valve is designed for summer operation, it will permit insufficient refrigerant to pass during the winter, even in the largest possible open condition which corresponds to a predetermined maximum superheating temperature. Conversely, if it is designed for winter operation, the required throttle cross-section is exceeded even for very small superheating temperatures.

The invention is based on the object of providing a thermostatic expansion valve of the aforementioned kind, of which the control characteristic is much less dependent than hitherto on fluctuations in the condenser pressure.

This object is achieved in accordance with the invention in that the setting element of the operating element is additionally loaded in the closing direction by the condenser pressure.

With this construction an excess force governed by the condenser pressure is permanently exerted in the closing direction and this force acts directly or indirectly on the operating element and supports the closing effect of the spring, so that the latter may be weaker. If the condenser pressure rises, the valve throttles more intensively, and vice versa. The valve can therefore be so designed that every alteration in the condenser pressure is compensated in the valve itself by a corresponding change in throttling so that the throughput quantity dependent on the superheating temperature of the evaporator substantially maintains its value. In this way a valve is therefore provided which is practically independent of the condenser pressure.

Desirably, the area exposed to the condenser pressure is larger than the free cross-section of the valve seat but less than that area of the operating element that is subjected to the pressure dependent on the superheating temperature. In this way one obtains favourable dimensions. When the closure member is subjected to the condenser pressure in the opening direction, the force thereby exerted in the opening direction is over-compensated. If the condenser pressure acts on the closure member in the closing direction, the latter can be kept sufficiently small, as is usual for expansion valves.

In a particularly preferred embodiment, a second operating element is provided of which the pressure chamber is connected by a passage to the supply line from the condenser. This second operating element can be effective anywhere in the line of force transmission between the closure member and the operating element. It is particularly favourable, however, if the second operating element is formed by a bellows can which concentrically surrounds the valve stem and of which the base is disposed between the end face of the valve stem and the setting element of the first operating element. This results in a structural unit which is very simple to make and assemble.

Further, the passage may be formed by the clearance between the valve stem and the hole in the housing receiving same. In this way a special hole will be avoided. A few microns will be sufficient clearance.

In a preferred embodiment, the first operating element comprises a diaphragm as the setting element and the bellows can of the second operating element is guided on a housing extension. Since the diaphragm does not have to be guided, the housing can be used for guiding the bellows can of the second operating element.

Further, a second passage may be provided in the housing to connect the chamber beyond the second operating element to the outlet line leading to the evaporator. In this way, the surface of the first operating element facing the closure member has a first portion subjected to the condenser pressure and a second portion subjected to the evaporator pressure.

This second passage may also lead to a nipple for connecting to an external pressure. This is particularly favourable if the valve is used in a plant having external pressure compensation and the nipple is connected to the suction conduit behind the senser.

The invention will now be described with reference to an example illustrated in the drawing wherein:

FIG. 1 is a longitudinal section through a thermostatic expansion valve according to the invention, and FIG. 2 is a longitudinal section through a modification.

A housing 1 has an inlet nipple 2 for connecting to the condenser, with a subsequent supply line 3, and an outlet nipple 4 for connecting to the evaporator, with a preceding outlet conduit 5. A closure member 6 is carried by a valve stem 7 which extends through the housing. Engaging the lower end there is a pressure plate 8 on which a spring 9 acts in the closing direction. This spring is supported by a screw 10 in a screw-threaded nipple 11 which is closed by a cover 12.

At the upper end of the housing there is a first operating element 13 in the form of a pressure cam. This comprises a diaphragm serving as setting element 14, an upper cover 15 and a lower cover 16 connected to the housing 1. The chamber 17 above the diaphragm 14 is connected to a temperature senser by a capillary tube 18 and receives vapour at a pressure depending on the senser temperature. The temperature senser is mounted at the outlet from the evaporator.

Below the diaphragm 14 there is a second operating element 19 in the form of a bellows can which concentrically surrounds the valve stem 7 and the base 20 of which is disposed between the end face of the valve stem 7 and the diaphragm 14. A cylindrical projection 21 of the housing 1 guides the corrugations of the bellows can. By means of the bellows can, the chamber beneath the diaphragm 14 is sub-divided into an inner chamber 22 and an outer chamber 23. The inner chamber 22 communicates with the supply line 3 and thus with the condenser pressure $P_k$ through a passage 24. The outer chamber 23 communicates with the outlet conduit 5 and thus with the evaporator pressure $P_o$ through a passage 25 (FIG. 1).

A valve seat 26 co-operating with the closure member 6 is formed at the open end of an axial hole 27. The free cross-section of the seat is thus formed by the cross-sectional area of the axial hole 27 minus the cross-sectional area of the valve stem 7. The area of the second operating element 19 subjected to the condenser pressure is equal to the area of the base 20 minus the cross-sectional area of the stem 7. This area subjected to the condenser pressure $P_k$ is larger than the free cross-sectional area of the seat 26 but smaller than the area of the diaphragm 14 subjected to the pressure in the chamber 17.

Instead of the passage 24 one may also utilise the clearance between the valve stem 7 and the hole in the housing for guiding same.

In FIG. 2 a passage 29 is provided which loads from the chamber 23 beyond the second operating element (19) to a nipple 30. Any external pressure source can be connected thereto. This is particularly suitable for a plant with external pressure compensation, in which the nipple is brought into communication with the suction conduit behind the senser of the thermostatic expansion valve.

I claim:

1. A thermostatic expansion valve assembly comprising a casing defining a chamber and inlet and outlet ports separated by a valve seat, a closure member cooperable with said valve seat and spring means biasing said closure member in a closing direction, a diaphragm dividing said chamber into upper and lower chambers with said upper chamber having a capillary tube inlet, a centrally disposed disk bearing against the lower side of said diaphragm, rod means between and attached to said disk and said closure member, a bellows in said lower chamber attached to said disk and surrounding said rod, first passage means providing fluid communication between said inlet port and the interior of said bellows to supplement the closing force of said spring means, second passage means in said casing which extends from said outlet port into a portion of said lower chamber externally of said bellows to provide fluid communication between said outlet port and said lower chamber exteriorly of said bellows to provide valve biasing pressure in the closing direction.

* * * * *